United States Patent [19]

Schrewe et al.

[11] 4,211,272

[45] Jul. 8, 1980

[54] COOLING OF INGOTS OR CASTINGS

[75] Inventors: Hans Schrewe, Duisburg; Fritz-Peter Pleschiutschnigg, Düsseldorf-Angermund, both of Fed. Rep. of Germany

[73] Assignee: Mannesmann Aktiengesellschaft, Düsseldorf, Fed. Rep. of Germany

[21] Appl. No.: 971,406

[22] Filed: Dec. 20, 1978

[30] Foreign Application Priority Data

Dec. 21, 1977 [DE] Fed. Rep. of Germany ..... 2757694

[51] Int. Cl.[2] ..... B22D 11/124

[52] U.S. Cl. ..... 164/89; 164/444

[58] Field of Search ..... 164/89, 443, 444, 118, 164/297, 126, 128, 348; 62/64, 373

[56] References Cited

U.S. PATENT DOCUMENTS

| | | | |
|---|---|---|---|
| 3,838,997 | 10/1974 | Becker et al. | 164/128 |
| 4,065,252 | 12/1977 | Hemsath et al. | 62/64 |
| 4,120,455 | 10/1978 | Wilmotte et al. | 164/444 |

FOREIGN PATENT DOCUMENTS

| | | | |
|---|---|---|---|
| 2512097 | 9/1976 | Fed. Rep. of Germany | 164/89 |
| 702687 | 1/1954 | United Kingdom | 164/444 |

*Primary Examiner*—Robert D. Baldwin
*Assistant Examiner*—K. Y. Lin
*Attorney, Agent, or Firm*—Smyth, Pavitt, Siegemund, Jones & Martella

[57] ABSTRACT

Ingots or castings are supported by fairly closely spaced rollers. The resulting spaces adjacent to exposed surface portions of the ingot or casting are filled with atomized water to generate a fog or mist being retained so that as much water droplets as possible vaporize by heat radiation from the ingot or casting, supplemented by radiation from the adjacent roller surfaces.

1 Claim, 3 Drawing Figures

COOLING OF INGOTS OR CASTINGS

BACKGROUND OF THE INVENTION

The present invention relates to cooling of ingots such as slab ingots as they are rolled, or about to be rolled, or as they leave a mold as a continuous casting. Generally speaking, the invention relates to cooling of an ingot at some point or points located downstream from a mold for continuous casting, such point or points may be located even in the range of the rolling mill that further processes the ingot.

From a different point of view, the invention relates to the cooling of ingots which are being moved by roller tracks and having a temperature requiring cooling.

Cooling a casting as it emerges from the mold is a prerequisite for further processing and particularly for completing the solidification as rapidly as possible. Usually, one will spray a coolant, e.g. water towards and onto the casting. German printed patent application No. 2,208,988 discloses equipment for this purpose. It is also known to convert the water into a fine mist prior to application as a coolant. See, e.g. the handbook by E. Hermann "Handbuch des Stranggiessens", pages 188 and 189. The German Patent No. 2,165,944 discloses also to blast a liquid-gas mixture at a high pressure transversely to the direction of casting and in-between the gaps of the widthdrawal rollers for the casting.

All these known methods and apparatus are disadvantaged by the fact that cooling is not uniform. The surface of the ingot is in parts shielded by the withdrawal rollers so that in any instant specific portions of the ingot are not being actively cooled by the sprayed on coolant because cooling has, in fact, been locally interrupted. A certain heat transfer will occur into the engaging rollers, but these rollers will become hot accordingly so that the heat flow into them is rather low. A remedy here is to cool the rollers internally, but still, cooling of the ingot is rendered non-uniform by its engagement with the rollers.

DESCRIPTION OF THE INVENTION

It is an object of the present invention to provide a new and improved method and equipment for cooling ingots, castings or the like as moved by means of roller tracks.

In accordance with the preferred embodiment of the present invention, it is suggested to fill the space as defined by (a) an exposed portion of the ingot or casting inbetween the two lines of engagement with respective two adjacent rollers of a track, and (b) by the surface portions of these two rollers adjacent thereto at least up to the area of shortest distance between these rollers, with a fog of coolant atomized with air under conditions of stagnation of the fog so that the droplets are exposed to the thermal radiation as exchanged between the ingot and the rollers and will be vaporized; outflow from this space is thus to be limited as much as possible to air the moisture content of which is vaporized coolant, being no longer in the liquid phase. It was found that this mode of cooling tends to uniformly cool the surfaces bounding the above-defined space so that supplemental internal cooling of the rollers is either not necessary at all or can be carried out at quite a lesser rate than was heretofore deemed necessary. The inventive method interrupts, so to speak, the heat exchange process through radiant energy between rollers and ingots, by extracting energy from the space as traversed by radiation and converting it into latent heat by the phase change from liquidous to gaseous.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, the figures illustrate a casting or ingot 10 as it is being held between an upper roller 3 of a track of withdrawal rollers and a lower roller 3' of a companion track underneath. As shown in FIGS. 2 and 3, the rollers of the same track are rather closely spaced, but any two juxtaposed rollers of such a track define a space 7 bounded additionally by exposed portions of the passing ingot 10, as between the two lines of engagement of the ingot and the respective two juxtaposed rollers.

Figure 1:
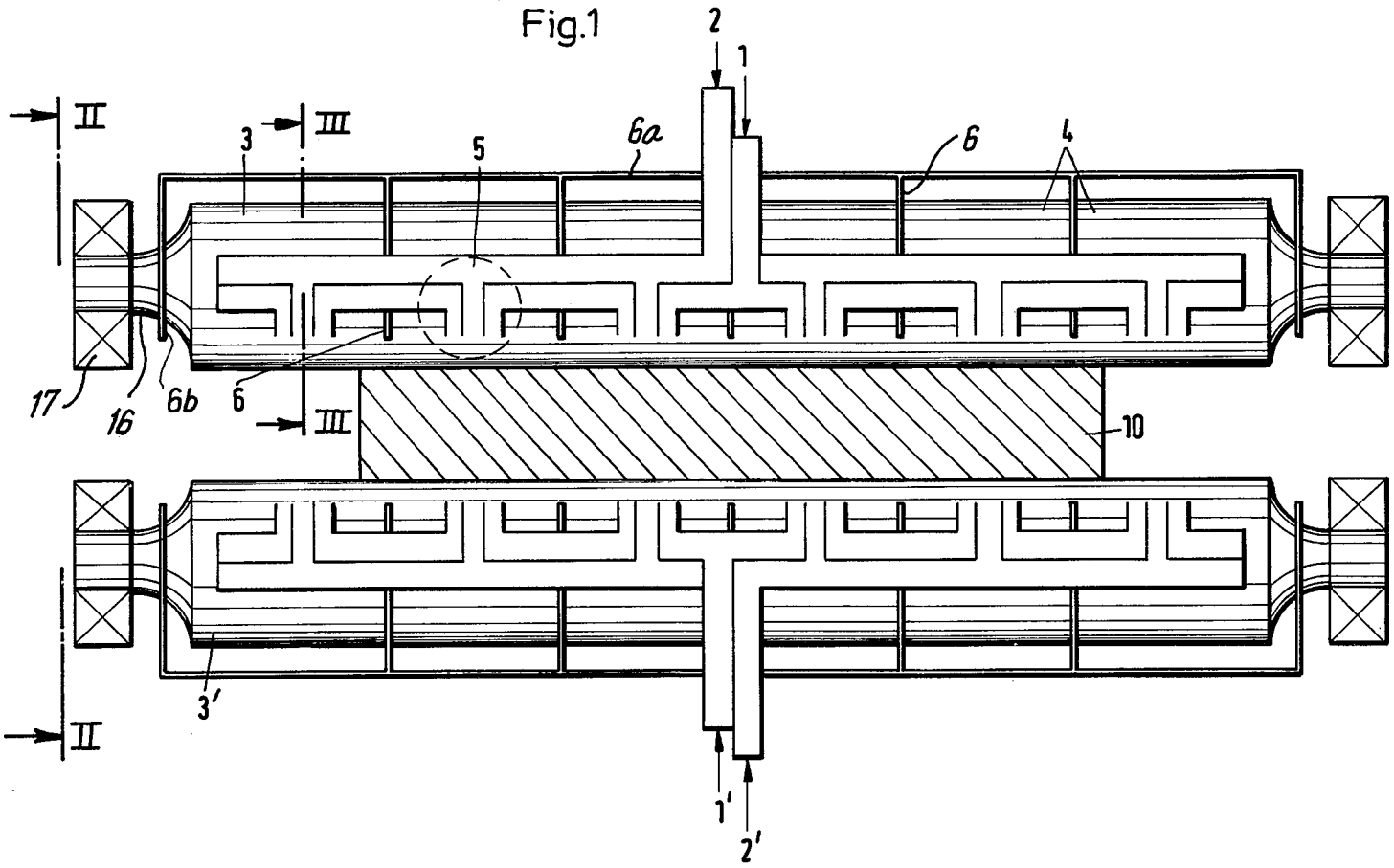
FIG. 1 is a cross-section through a withdrawal track and path for a continuous casting, the section plane being taken transversely to the direction of casting and/or casting movement.

Chambers 4 are defined between each two such juxtaposed rollers which include partitions 6, top walls **6*a*, as well as end walls 6*b*, adjacent to the roller journals 16 in bearings 17. These chambers each contain two-component nozzles 5 which are respectively fed with air 1 and water 2 through suitable manifolds. The lower spaces are fed with air 1' and water 2'**, accordingly.

The two component nozzles 5 generate a mist or fog which is directed towards the ingot's surface, but not by way of high speed impact flow. Rather, this fog stagnates in the spaces 7 as defined, above the exposed surface portions of the ingot, and fills that space without being forced out. This, in turn, exposes the entire fog to the radiation energy from the ingot as well as from the roller surfaces. The water droplets, thus, intercept this radiation field and evaporate, i.e. they undergo a phase change from the liquid phase into the gaseous phase and absorb thermal energy in form of latent heat due to the vaporization. The mist of water droplets will also fill the gap between adjacent rollers above the area of closest distance, to intercept the radiation as between the two rollers.

It follows that the relevant hot surfaces involved in the operation face a fog which serves as a radiation heat sink. In addition, of course, there is significant contact between water droplets and the surfaces of the rollers and the ingot. As a consequence, the rollers and the ingot loose as much thermal energy as can be absorbed in that fashion. The water droplets are, of course, to some extent directed towards the ingot and the chambers 4 are filled with flowing droplets, but the essential aspect is that the flow be contained to some extent for preventing outflow of still liquidous coolant as much as possible. It is essential that in any instant the space 7 be filled as much as possible with fine droplets which will rapidly vaporize, but the fog is readily replenished by and through the nozzles 5.

The rate of cooling is, of course, determined by the throughput of water. Moreover, the cooling of the ingot through heat transfer into the roller and the companion heating of the rollers is hardly different from the radiation cooling of the exposed ingot. Moreover, following the heating of a roller increment, it soon is exposed to fog filled space and looses heat by radiation.

The partitions 6, and here particularly the end partitions **6*b* cause a significant degree of stagnation and dammingup of the mist so that the spaces 7 as defined and chambers 4 are continuously filled and refilled with droplets which will evaporate sooner or later due to absorption of radiant energy. By and large, partitions 6 and 6*b* are contoured to the rollers, leaving a narrow clearing space so that rotation is not impeded but the spaces 7 and chambers 4** are more or less closed for the retention of the fog.

Experiments have shown that without cooling as per the invention, 80% of the heating of the transport rollers 3, 3' results from heat influx by radiation as between ingot and rollers; only 20% of the heat transfer is conductive due to contact between rollers and ingot. The space 7 through which this heat radiation passes, is now occupied to a considerable extent by water droplets which intercept the radiation, absorb it and withdraw it from the roller-ingot system. That throughput, in terms of quantity per unit time, should be metered so that the corresponding capacity of latent heat of vaporization exceeds the amount of radiation from the ingot surface into a space per unit time plus the amount of heat lost conductively, e.g. into the rollers. This, in turn, equalizes the overall heat outflow from the ingot's surface into the environment, in other words, the cooling of any ingot surface increment as it is alternatingly exposed and shielded by contacting rollers is much more uniform. This means that the rollers do not have to be cooled or only to the extent of any residual heat influx through the physical contact between rollers and ingot.

Figure 2:
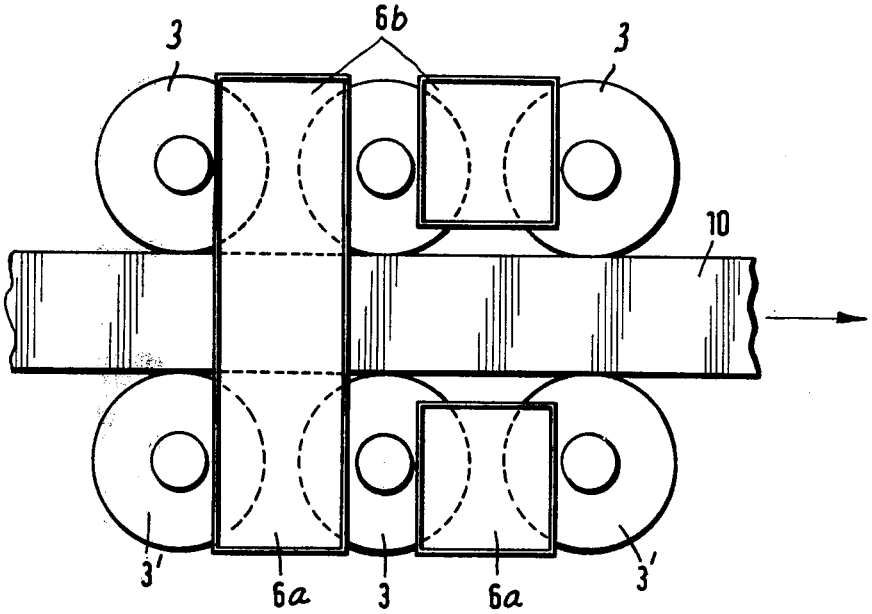
FIG. 2 is a side view of the device shown in FIG. 1 as indicated by lines II—II therein.
Figure 3:
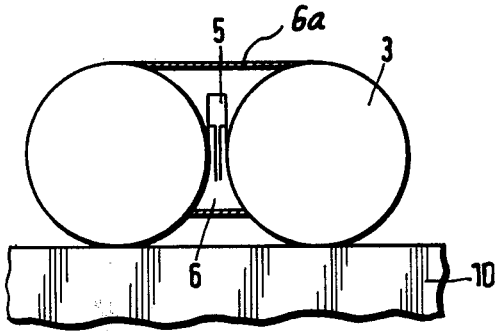
FIG. 3 is a section view taken along line III—III in FIG. 1.

FIG. 2 illustrates that the end partitions **6*a* extend laterally between bearings and the end faces of the rollers 3, 3', etc. Thus, mist and fog is also retained adjacent to these end faces so that they, in turn, are likewise cooled. Moreover, FIG. 2** shows one instance of a down extension of these end partitions to cause a portion of the fog to be retained adjacent to the small side of the ingot as depicted in this figure so that they will be cooled also.

The invention is not limited to the embodiments described above but all changes and modifications thereof not constituting departures from the spirit and scope of the invention are intended to be included.

We claim:

1. Method of cooling ingots or castings moved and supported by means of roller tracks, there being a plurality of spaces, each bounded by a surface portion of an ingot or casting between lines of contact with respective two adjacent rollers of one of the tracks, chamber means and adjacent surface portions of these rollers, comprising the steps of:

atomizing a coolant by means of air in order to produce a coolant fog or mist within each of said spaces;

retaining the fog or mist in the space in a stagnant flow, so that essentially only air with vaporized water in the gaseous phase escapes from said space and liquid coolant droplets constituting the fog or mist stagnate and float in said space, filling it completely and being exposed to radiation from said surface portions; and wherein the coorresponding amount of latent heat of vaporization of the atomized coolout fed to said space per unit time is larger than the amount of heat radiated by said surface portion of the ingot or casting into said space plus the amount of heat transferred by conduction out of said surface portion into at least one of the two rollers.

* * * * *